US007789814B1

(12) United States Patent
Xu

(10) Patent No.: US 7,789,814 B1
(45) Date of Patent: Sep. 7, 2010

(54) DEVICE FOR HANGING WEIGHTS TO AN ELONGATED BAR MEMBER

(75) Inventor: Qinghao Xu, 910 Sailfish Pl., Carlsbad, CA (US) 92011

(73) Assignee: Qinghao Xu, San Diego, CA (US)

( * ) Notice: Subject to any disclaimer, the term of this patent is extended or adjusted under 35 U.S.C. 154(b) by 0 days.

(21) Appl. No.: 12/428,755

(22) Filed: Apr. 23, 2009

(51) Int. Cl.
*A63B 21/072* (2006.01)
*A63B 21/06* (2006.01)

(52) U.S. Cl. ..... 482/107; 482/93

(58) Field of Classification Search ..... 482/93, 482/104, 106–108, 139; 24/332, 334, 544, 24/550, 3.11, 131 C, 509, 599.7
See application file for complete search history.

(56) References Cited

U.S. PATENT DOCUMENTS 437,877 A * 10/1890 Truax ..... 24/507
871,888 A * 11/1907 Porter ..... 24/550
4,569,105 A * 2/1986 Weider ..... 482/107
4,681,315 A * 7/1987 Yang ..... 482/50
6,436,016 B1 * 8/2002 Valentino ..... 482/108
6,715,728 B2 * 4/2004 Nielsen ..... 248/339
6,945,918 B1 * 9/2005 Hill ..... 482/106
7,025,712 B2 * 4/2006 Parrilla ..... 482/104
7,073,761 B2 * 7/2006 Diggle et al. ..... 248/304
7,081,071 B2 * 7/2006 Smith ..... 482/105
7,520,844 B1 * 4/2009 Flynn ..... 482/105

* cited by examiner

*Primary Examiner*—Fenn C Mathew
(74) *Attorney, Agent, or Firm*—Gavrilovich, Dodd & Lindsey LLP; Gregory P Einhorn

(57) ABSTRACT

A compact device for attaching weights to an elongated rod. One embodiment of the device comprises a tubular member and two arms attached to the tubular member. The tubular member can be slid onto the end of the elongated rod. Each of the two arms has a plurality of hook-shaped openings. Each pair of the corresponding hook-shaped openings defines a pocket for receipt of a bar member, such as the handle of a dumbbell. One device can be attached to each end of the elongated rod for supporting a plurality of dumbbells on each end thereof to thereby convert pairs of dumbbells into a barbell. Other embodiments are described and shown.

3 Claims, 3 Drawing Sheets

DEVICE FOR HANGING WEIGHTS TO AN ELONGATED BAR MEMBER

CROSS-REFERENCE TO RELATED APPLICATIONS

Not applicable

FEDERALLY SPONSORED RESEARCH

Not applicable

SEQUENCE LISTING OR PROGRAM

Not applicable

BACKGROUND

1. Field

This application relates generally to exercise equipment and more specifically it relates to a hanging device that allows dumbbells to be attached to a barbell bar for use as weights for barbells.

2. Prior Art

Discussion of Prior Art

Weightlifting is a popular sport activity. Depending on the routines, it builds strength, stamina and muscle mass. Free weights are superior to weight machines in that they allow more balanced development of strength, coordination and agility. The most commonly used free weight devices consist of a barbell having an elongated cylindrical lifting bar with disk-shaped weights removably placed on either end of the bar. Other free weight devices include dumbbells, which generally have a bar handle with weights on either end. Both barbells and dumbbells are great options for free weight exercises however they have different benefits. For example, a barbell is more convenient for squat, deadlift and power clean, while dumbbells allow a greater range of motion and are great for symmetrical development of muscle.

Previously, effort was made to design a combination device in which dumbbells can be used as a barbell or for added weights to a barbell cross bar. For example, U.S. Pat. No. 1,366,200 to Matysek (1921) describes a bar having a number of apertures therethrough and a pair of dumbbells each having a large aperture therethrough sized to slide onto the end of the bar. A pair of cotter pins or the like can then be slid through the apertures in the bar on either side of the dumbbell to lock the dumbbells in place to provide dumbbells on a barbell type bar. This prior system has the disadvantage in that the dumbbell handles have to be large enough to have an aperture that will slide onto a barbell bar and still give sufficient strength in the handles. The handles then become unduly large, which do not comfortably fit the hands of the user. In addition, both the bar and the dumbbell need to be custom made, which are expensive. In U.S. Pat. No. 5,496,243 to Allen (1996) for an exercising device, a weight lifting bar is provided having a bracket attached to each end. Each of a pair of dumbbells is latched into the bracket so that the dumbbells can be used as weights for a barbell. However, each device can accommodate only one dumbbell. In U.S. Pat. No. 7,081,072 B2 to Allen (2006), a handle of a dumbbell is connected to a bar clamp. The bar clamp has an elongated open sided tube which receives the handle of the dumbbell. A tubular extension extends perpendicular from the open sided tube for attaching to a matching bar, thereby converting a pair of dumbbells into a barbell. Unfortunately, each bar clamp can accommodate only one dumbbell. In addition, the tubular extension cannot be securely retained on the bar, which presents a safety concern.

SUMMARY

In accordance with one embodiment a device for attaching dumbbells to a barbell bar comprises a tubular member sized to be slid onto the end of the barbell bar and two arms each having a plurality of hook-shaped structures, which can support a plurality of dumbbells thereon.

DRAWINGS

Figures

DETAILED DESCRIPTION

Figure 1:
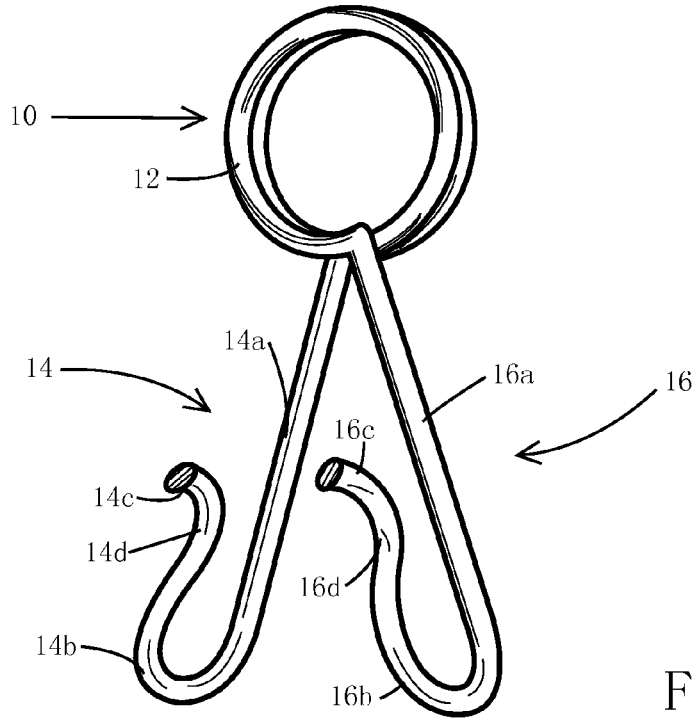
FIG. 1 shows a perspective view of an embodiment of the device.

FIG. 1—First Embodiment

FIG. 1 shows a perspective view of a one version of my widget. The device 10 is preferably formed from a length of heavy gauge metal wire. The middle portion of the wire is formed into a cylindrical coil 12 and each end portion is formed into an arm, such as arm 14 and 16. Each arm 14 and 16 is bent so that it extends radially outward from coil 12 and is generally perpendicular thereto. The free end portion of each arm is bent to form a hook 14*b* and 16*b*, which is generally parallel to each other. The end of each hook 14*c* and 16*c* is further bent away from each respective arm shaft 14*a* and 16*a*. Hook end 14*c* and hook 14*b* are joined by a curved portion 14*d*. Similarly, hook end 16*c* and hook 16*b* are joined by a curved portion 16*d*.

Figure 2:
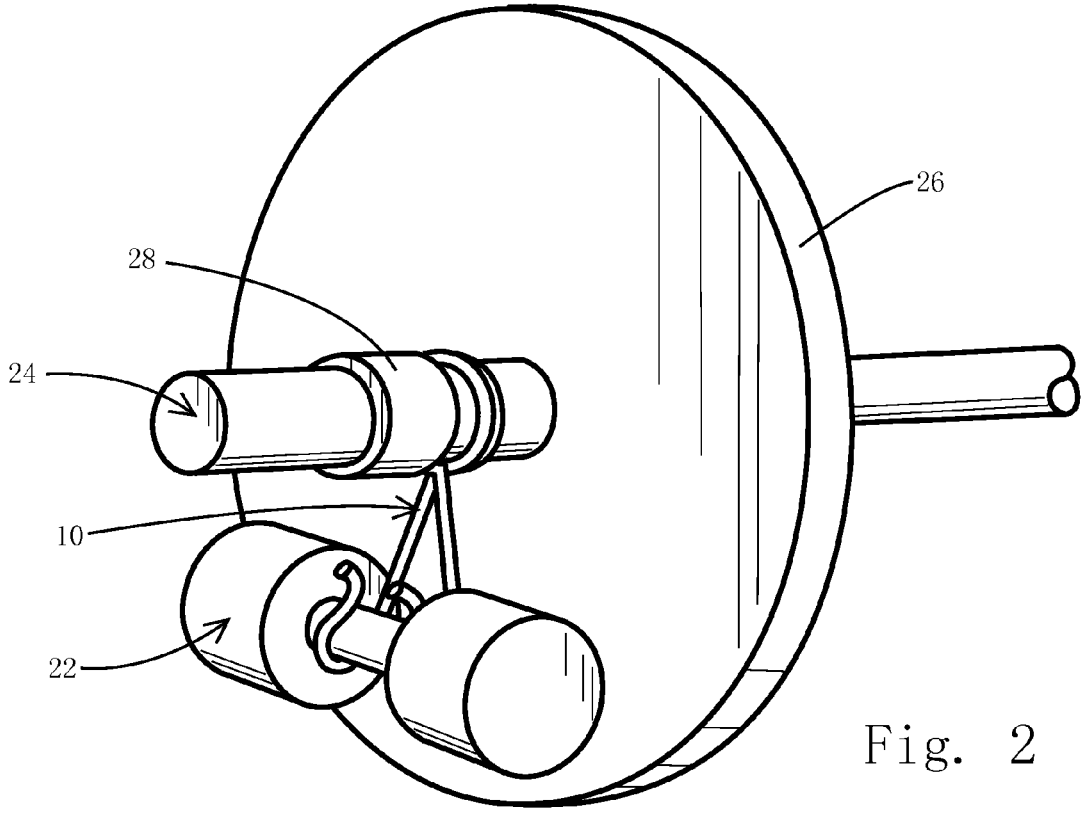
FIG. 2 shows a perspective view of the device on one end of a barbell bar to attach a dumbbell to the barbell bar.

Operation—FIGS. 1 and 2

Device 10 is designed to attach weights, such as dumbbells to a barbell cross bar. Coil 12 is sized to be slid onto the end of a barbell cross bar. A weight collar can then used to secure device 10 on the bar. Hooks 14*b* and 16*b* together define a pocket for receipt of a section of a dumbbell handle. The distance between curved portion 14*d* and arm shaft 14*a* is slightly shorter than the diameter of the dumbbell handle. When hook end 14*c* is bent away from arm shaft 14*a*, the distance between curved portion 14*d* and arm shaft 14*a* increases to allow the dumbbell handle to be engaged in hook 14*b*. When hook end 14*c* is released, its spring qualities would allow it to return to its original position. Because the distance of curved portion 14*d* and arm shaft 14*a* is shorter than the diameter of the dumbbell handle, curved portion 14*d* would inhibit unintended disengagement of the dumbbell handle from the pocket formed by hooks 14*b* and 16*b*. Similarly, curved portion 16*d* will inhibit unintended disengagement of the dumbbell handle from the pocket formed by hooks 14*b* and 16*b*.

FIG. 2 shows a perspective view of device 10 in use. A dumbbell 22 is attached to one end of a barbell bar 24 by device 10. On the same end of bar 24, there is a conventional weight plate 26. A weight collar 28 secures device 10 and weight plate 26. It should be understood that device 10 and dumbbell 22 mounted therein could be used alone without weight plate 26. Typically two devices are used with each barbell bar, one at each end of the bar.

FIGS. 3-7—Additional Embodiments

Figure 3:
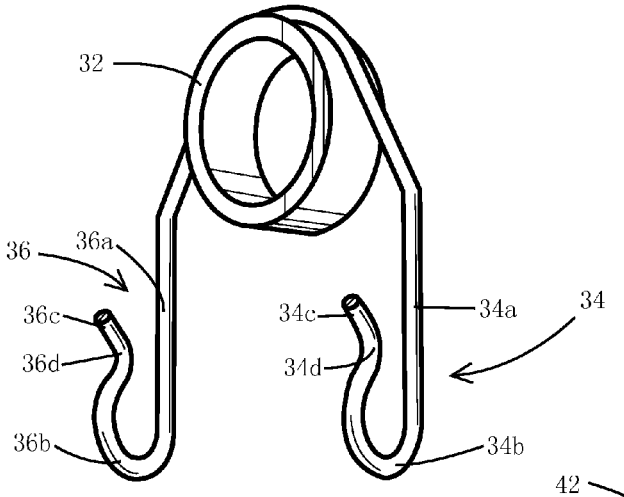
FIG. 3 shows a perspective view of a second embodiment of the device.

There are various possibilities with regard to the forms of the present widget might take. FIG. 3 illustrates a second embodiment. The device is composed of a tubular member 32 and two arms 34 and 36 that are attached to tubular member 32. Tubular member 32 can be slid onto the end of a barbell bar. The shape, spatial arrangement and operation of arms 34 and 36 in FIG. 3 are similar to those of arms 14 and 16 in FIG. 1. Briefly, arms 34 and 36 are formed in such a way that they extend radially outward from tubular member 32. The free end portion of each arm is bent to form a hook 34*b* and 36*b*, which is generally parallel to each other. The end of each hook 34*c* and 36*c* is further bent away from each respective arm shaft 34*a* and 36*a*. Hook end 34*c* and hook 34*b* are joined by a curved portion 34*d*. Similarly, hook end 36*c* and hook 36*b* are joined by a curved portion 36*d*. Once a dumbbell handle is engaged in the pocket formed by hooks 34*b* and 36*b*, curved portions 34*d* and 36*d* would prevent the handle from unintended disengagement.

Figure 4:
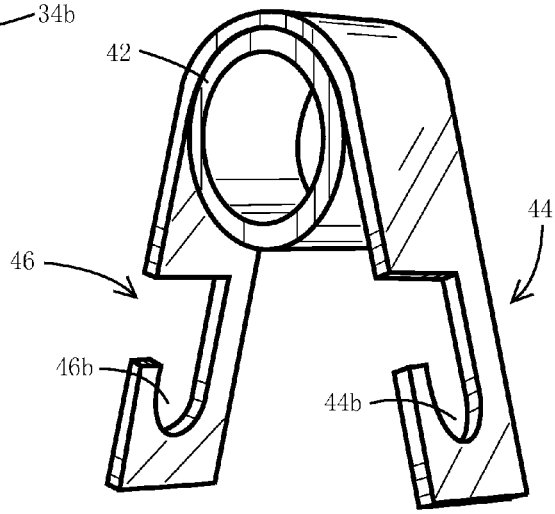
FIG. 4 shows a perspective view of a third embodiment of the device.

FIG. 4 shows a third embodiment of the present widget. The device is composed of a tubular member 42 and two side plates 44 and 46. Tubular member 42 can be slid onto the end of a barbell bar. A first side plate 44 has a hook-shaped edge opening 44*b*. A second side plate 46 has a corresponding hook-shaped edge opening 46*b*. Edge openings 44*b* and 46*b* together define a pocket for receipt of a section of a dumbbell handle. Edge openings 44*b* and 46*b* are upwardly open to inhibit unintended disengagement of the dumbbell handle from the pocket.

Figure 5:
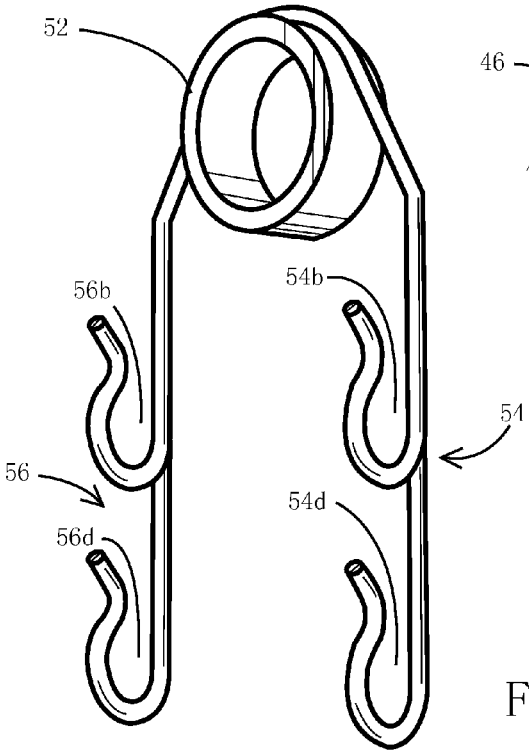
FIG. 5 shows a perspective view of a fourth embodiment of the device.

FIG. 5 shows a fourth embodiment of the widget. The device is composed of a tubular member 52 and two arms 54 and 56. Tubular member 52 can be slid onto the end of a barbell bar. Arms 54 and 56 are formed in such a way that they extend radially outward from the tubular member. A first arm 54 has two vertically spaced hooks 54*b* and 54*d*. A second arm 56 has two corresponding vertically spaced hooks 56*b* and 56*d*. Each pair of corresponding hooks defines a pocket for receipt of a section of a dumbbell handle. Each device can accommodate two such handles.

Figure 6:
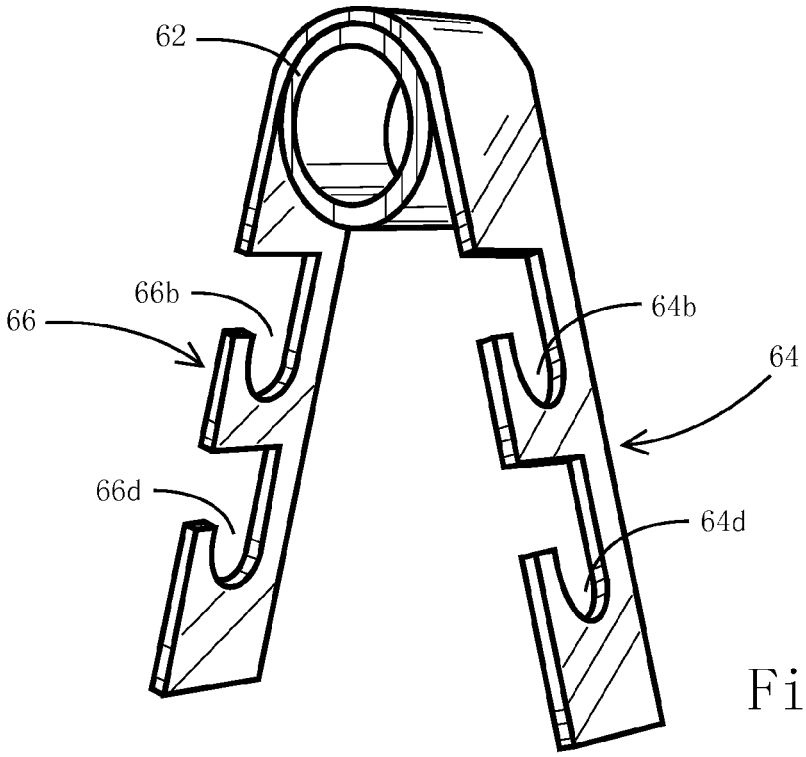
FIG. 6 shows a perspective view of a fifth embodiment of the device.

FIG. 6 shows a fifth embodiment of the widget. The device is composed of a tubular member 62 and two side plates 64 and 66. Tubular member 62 can be slid onto the end of a barbell bar. A first side plate 64 has two vertically spaced hook-shaped edge openings 64*b* and 64*d*. A second side plate 66 has two corresponding vertically spaced hook-shaped edge openings 66*b* and 66*d*. Each pair of corresponding edge openings defines a pocket for receipt of a section of a dumbbell handle. Each device can accommodate two such handles.

Figure 7:
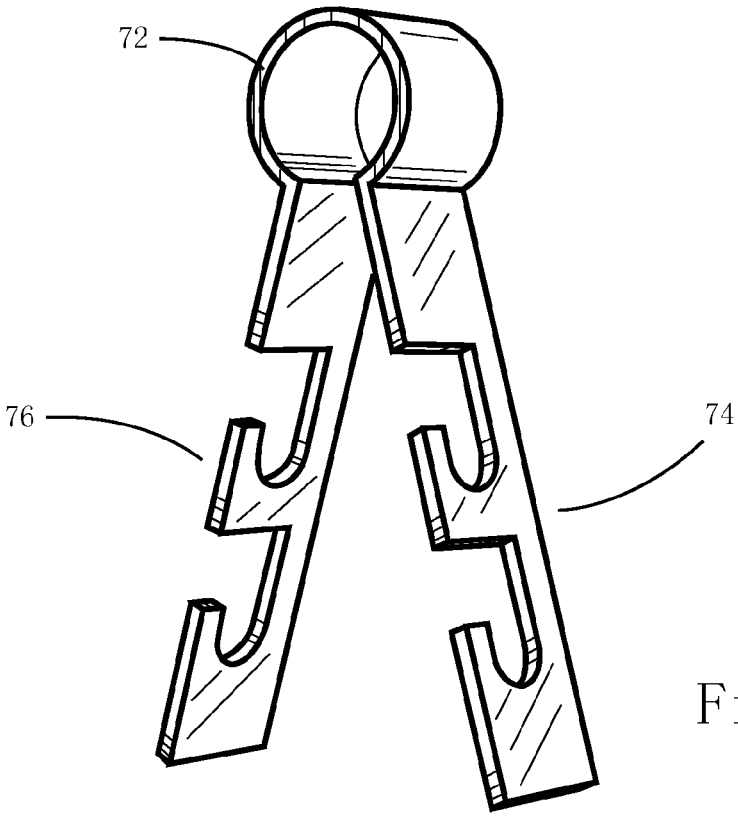
FIG. 7 shows a perspective view of a sixth embodiment of the device.

FIG. 7 shows a modified form of the device in FIG. 6. Tubular member 72 is open sided with each side integrally joined to each of a pair of side plates 74 and 76.

Advantages

From the description above, a number of advantages of some embodiments of my widget become evident:

(a) The device is inexpensive to manufacture.

(b) The device and the dumbbells mounted therein can be securely retained on a barbell bar, when a weight collar is used, such as in FIG. 2.

(c) Each device can accommodate a plurality of dumbbells.

(d) The device has a compact configuration. Therefore, additional conventional weight plates can be placed on the same end of a barbell bar that the device is attached to, such as in FIG. 2.

(e) The device can be used to attach other types of weights that have bar handles, such as kettlebells, to a barbell bar.

Accordingly, the reader will see that the device is safe, inexpensive, compact, versatile and easy-to-use. It greatly expands the utility of dumbbells. It will save users who already own dumbbells from purchasing additional weight plates for barbell exercises.

Although the description above contains many specificities, these should not be construed as limiting the scope of the embodiments but as merely providing illustrations of some of the presently preferred embodiments. It should be understood that many changes, both as to material and structure, might be made to the device by one of ordinary skill in the art, without departing from the spirit and scope of the application.

Thus the scope of the embodiments should be determined by the appended claims and their legal equivalents, rather than by the examples given.

I claim:

1. A device for removably attaching a weight to an elongated rod, comprising:

a generally tubular or cylindrical member sized to be slid onto said elongated rod;

wherein said tubular member has a pair of arms extending therefrom;

said first arm and said second arm each having at least one open hook-shaped or notch-shaped opening;

said first arm and said second arm being substantially symmetrical;

and said hook-shaped or notch-shaped opening on said first arm and the corresponding hook-shaped or notch-shaped opening on said second arm are positioned substantially parallel to one another such that each can receive said weight, and the corresponding hook-shaped or notch-shaped openings on the first and second arm are positioned in relation to each other such that a bar can be removably placed into the openings and that said bar when placed into the openings is substantially perpendicular to said elongated rod;

wherein said bar comprises the handle of a dumbbell; and wherein a pair of weight-hanging devices are each slidably attached to the end of a barbell weight bar and each has a dumbbell handle mounted therein to thereby convert a pair of dumbbells into a barbell.

2. The device of claim 1, wherein said tubular member comprises a coil formed from the end of a wire and each said arm is formed from each end of said wire.

3. A device for removably attaching a weight to an elongated rod, comprising:

a generally tubular or cylindrical member sized to be slid onto said elongated rod;

wherein said tubular member has a pair of arms extending therefrom;

said first arm and said second arm each having at least one open hook-shaped or notch-shaped opening;

said first arm and said second arm being substantially symmetrical;

and said hook-shaped or notch-shaped opening on said first arm and the corresponding hook-shaped or notch-shaped opening on said second arm are positioned substantially parallel to one another such that each can receive said weight, and the corresponding hook-shaped or notch-shaped openings on the first and second arm are positioned in relation to each other such that a bar can be removably placed into the openings and that said bar when placed into the openings is substantially perpendicular to said elongated rod;

wherein said two arms comprise two side plates and said hook-shaped opening comprises a hook-shaped edge or notched opening on each said plate.

* * * * *